United States Patent [19]

Aigner

[11] Patent Number: 4,962,605

[45] Date of Patent: Oct. 16, 1990

[54] FIREARM PROVIDED WITH AN IMPROVED TRIGGER MECHANISM

[75] Inventor: Friedrich Aigner, St. Valentin, Austria

[73] Assignee: Steyr-Daimler-Puch AG, Vienna, Austria

[21] Appl. No.: 472,594

[22] Filed: Jan. 30, 1990

[30] Foreign Application Priority Data

Jan. 31, 1989 [AT] Austria ..... 185/89

[51] Int. Cl.[5] ..... F41A 17/48; F41A 19/10

[52] U.S. Cl. ..... 42/69.01; 42/70.06

[58] Field of Search ..... 42/69.01, 69.02, 69.03, 42/70.01, 70.06

[56] References Cited

U.S. PATENT DOCUMENTS 2,539,554 1/1951 Sampson et al. ..... 42/69.02

*Primary Examiner*—Charles T. Jordan
*Assistant Examiner*—Richard W. Wendtland
*Attorney, Agent, or Firm*—Marmorek, Guttman & Rubenstein

[57] ABSTRACT

A firearm, particularly a piston, is provided with a trigger mechanism, which comprises a spring-loaded trigger rod, a trigger for moving the trigger rod, and locking means for preventing a movement of the trigger rod other than by an operation of the trigger. The trigger rod is slidably mounted and guided in the receiver of the firearm for a movement along a straight line. The trigger is directly mounted on the trigger rod for a limited pivotal movement. A spring is provided, which biases the trigger for a forward pivotal movement and exerts a forward tensile force on the trigger rod and when the trigger is in its initial position retains a nose of the trigger in a notch of the receiver.

2 Claims, 1 Drawing Sheet

FIREARM PROVIDED WITH AN IMPROVED TRIGGER MECHANISM

BACKGROUND OF THE INVENTION

1. Field of the Invention

This invention relates to a trigger mechanism for firearms, particularly pistols, comprising a spring-loaded trigger rod, a trigger for moving said trigger rod, and locking means for locking said trigger rod when said trigger is in an initial position.

2. Description of the Prior Art

The trigger rod serves to transmit the movement of the trigger and the forces exerted on the trigger to succeeding members of the trigger mechanism for the discharge of a round. The discharge of a round is prevented by the locking means, which automatically assume a locking position and ensure that no round can be discharged, e.g., in response to an impact exerted on the firearm in its longitudinal direction or when the firearm falls on the ground. A discharge of a round will be prevented in such cases even when the safety catch has been released and the firearm is ready to fire.

Such locking means are already known in practice. But in the firearms provided with such known locking means the trigger is pivoted on a stationary axis in the receiver of the firearm and carries a lever, which extends in the trigger and protrudes slightly from the contour of the trigger and unlocks the trigger rod as soon as the trigger is actuated by the finger of the hand which holds the firearm so that the round can then be discharged. That lever which protrudes from the contour of the trigger must be forced back by the finger into the trigger and will render the operation of the trigger mechanism more difficult and a higher structural expenditure will be incurred because a separate lever must be mounted on on a separate pivot in the trigger. That lever in its initial position will prevent a complete pivotal movement of the trigger so that a movement of the trigger rod will be prevented. Besides that lever must be rather thin because it must be accommodated in the trigger.

SUMMARY OF THE INVENTION

For this reason it is an object of the invention to eliminate said disadvantages and to provide a firearm with a trigger mechanism which is of the kind described first hereinbefore and in which additional components are not required for the locking means which will be disabled in response to the actuation of the trigger and said locking means do not render the operation of the trigger mechanism more difficult. Besides, the structure of the trigger mechanism should be simplified.

In a firearm comprising a receiver, that object is accomplished in accordance with the invention in that the trigger rod is slidably mounted and guided in the receiver for a movement along a straight line, the trigger is directly pivoted on the trigger rod for a limited pivotal movement and a spring is provided, which biases the trigger for a forward pivotal movement and biases the trigger rod with a forwardly directed tensile force and a nose provided on the trigger is held in a notch by said spring when the trigger is in its initial position.

Because the trigger is directly mounted on the trigger rod rather than in the receiver of the firearm as in the prior art, the structure will be simplified as an additional coupling between the trigger and the trigger rod will no longer be required. It will be understood that the trigger rod must properly be guided in the receiver of the firearm. Such a guidance can be provided without a need for an additional structural expenditure. The spring serves to move the trigger and the trigger rod to their forward initial position. The spring serves also to hold the nose of the trigger in the notch when the trigger is in its position of rest and to return that nose into said notch when the round has been discharged. For this reason there is no need for a separate lever which is accommodated in the trigger and which could interfere with the operation of the trigger mechanism. As the trigger is swung back in its normal operation, the nose is pivotally moved out of the notch so that the trigger rod is released for a rearward movement against the spring force as the rearward movement of the trigger is continued. It is seen that the overall structure is very simple.

BRIEF DESWCRIPTION OF THE DRAWINGS

DETAILED DESCRIPTION OF THE PREFERRED EMBODIMENT

Figure 1:
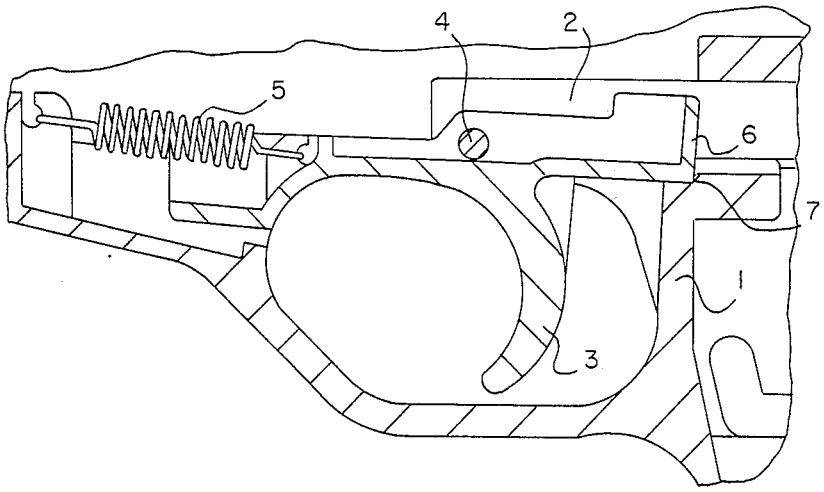
FIG. 1 is a sectional view showing those parts of a pistol which are essential for the invention with the trigger mechanism in its initial position.

An illustrative embodiment of the invention will now be described more in detail with reference to the drawing.

The pistol comprises a receiver 1, in which the trigger rod 2 is slidably mounted and guided along a straight line. The trigger 3 is mounted on the trigger rod 2 for a limited pivotal movement about the pivot 4. The trigger 3 is engaged by a spring 5, which tends to impart a forward pivotal movement to the trigger 3 and which exerts a forward tensile force on the trigger rod 2 because the trigger 3 and the trigger rod 2 are interconnected by the pivot 4 for the trigger 3.

The spring 5 is a tension spring, which at one end is connected to the receiver 1 and at the other end is connected to the trigger 3.

The trigger 3 is provided at its rear end with a nose 6. The receiver 1 is formed with a notch 7. When the trigger 3 is in its initial position shown in FIG. 1 the spring 5 will retain the nose 6 in the notch 7. In that case the trigger rod 2 will be locked and a discharge of a round by the firearm will be prevented because those additional parts of the trigger mechanism which are coupled to the rear end of the trigger rod and are operable to effect the discharge of a round—said additional parts are not shown—will also be held in position.

Figure 2:
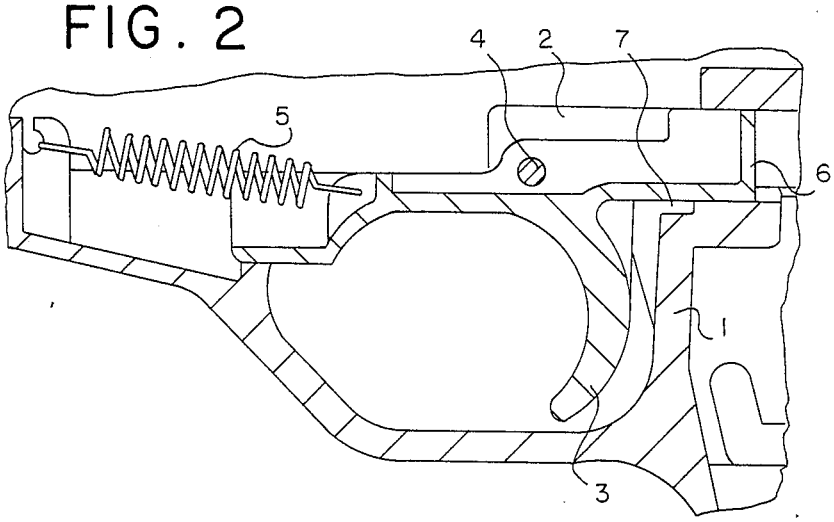
FIG. 2 is a similar view showing the parts at the end of the operation of the trigger.

Upon an actuation of the trigger 3 the latter is first pivotally moved in the counterclockwise sense when viewed as in the drawing. As a result, the nose 6 will leave the notch 7 so that the trigger 3 and the trigger rod 2 will be released for a rearward movement to discharge a round. The final position resulting from that movement is shown in FIG. 2.

What is claimed is:

1. In a firearm comprising a receiver and a trigger mechanism, wherein said trigger mechanism comprises a trigger rod spring means biasing said trigger rod forwardly, a trigger, which is operable rearwardly from an initial position to move said trigger rod rearwardly against the force of said spring means, and locking means for locking said trigger rod when said trigger rod is in said initial position, the improvement residing in that said trigger rod is slidably mounted and guided in said receiver for a movement along a straight line, said trigger is directly pivoted to said trigger rod for a limited pivotal movement and is provided with a nose, said receiver is formed with a notch, which is arranged to receive said nose when said trigger is in said initial position and said spring means comprise a spring, which biases said trigger for a forward pivotal movement and which exerts on said trigger rod a forward tensile force and is arranged to hold said nose in said notch when said trigger is in said initial position.

2. The improvement set forth in claim 1 as applied to a firearm which consists of a pistol.

* * * * *